United States Patent [19]

Chernock

[11] 3,961,876

[45] June 8, 1976

[54] VALVE ASSEMBLY

[76] Inventor: Stephen P. Chernock, Flax Mill Lane, Milford, Conn. 06460

[22] Filed: June 6, 1974

[21] Appl. No.: 477,037

[52] U.S. Cl. ..... 431/344; 431/254; 431/277; 251/320; 251/323

[51] Int. Cl.[2] ..... F23D 13/04

[58] Field of Search ..... 431/130, 131, 142, 143, 431/150, 254, 276, 277, 344; 222/3; 251/322, 354, 320; 137/537

[56] References Cited

UNITED STATES PATENTS

| | | | |
|---|---|---|---|
| 951,855 | 3/1918 | Sullivan | 251/320 |
| 1,196,861 | 9/1916 | Hayes | 137/537 |
| 2,657,563 | 11/1953 | Burchett | 251/320 |
| 3,096,636 | 7/1963 | Newman | 431/344 |
| 3,213,647 | 10/1965 | Sakamoto | 431/276 |
| 3,218,831 | 11/1965 | Newman | 431/344 |
| 3,229,486 | 1/1966 | Quandt | 431/150 |
| 3,606,088 | 9/1971 | Baltzer | 251/320 |
| 3,730,222 | 5/1973 | Prisk | 251/323 |

*Primary Examiner*—Carroll B. Dority, Jr.
*Attorney, Agent, or Firm*—Mattern, Ware, Davis & Stoltz

[57] ABSTRACT

By externally mounting a resiliently flexible member about a valve stem so as to biasingly engage the valve stem with the valve housing in the closed position, a unique, self-contained, captured valve assembly is provided. In the preferred embodiment, the flexible biasing member comprises a rubber material which peripherally surrounds the valve stem and the valve housing. This valve assembly is particularly useful in gas lighters of the butane fuel type, since the preferred embodiment provides a seal against leakage and secondary ignition.

4 Claims, 6 Drawing Figures

VALVE ASSEMBLY

BACKGROUND OF THE INVENTION

This invention relates to valve assemblies, and more particularly to self-contained, captured valve assemblies.

Generally, all valve assemblies comprise a valve housing, having one portal exposed to the combustible fluid, and a valve stem, mounted within the housing and either in contact with the housing or a gasket material. The valve stem is movable from a closed position, preventing flow of the combustible fluid to an open position allowing the combustible material to pass through the valve stem.

Valve assemblies can generally be classified as either "captured" and "self-contained" or "uncaptured". The captured valve assemblies comprise a closed unit with the valve stem, valve housing, gasket material, if used, and biasing member enclosed therein forming a single unitary product. The uncaptured valve assemblies have each component separate, requiring a final assembly and an external member to bias the valve stem in the closed position.

The major difference between captured valve assemblies and uncaptured valve assemblies is the cost of manufacturing. In the captured, or self-contained, valve assembly, the biasing member, which is generally a spring, is mounted directly within the valve assembly under compression in a manner which biases the valve stem into the closed position with the valve housing. In order to produce a valve stem which will accomodate the captured spring and allow the valve stem to be biasingly engaged with the valve housing, the valve stem must be separately machined and, as a result, is an expensive item to manufacture. Consequently, the captured or self-contained valve assembly, although preferable in most applications since assembly is complete, is a more expensive valve assembly, due to the labor involved and the cost of manufacturing.

In the uncaptured valve assembly, the valve stem may be die-cast, since its construction is relatively simple compared to the captured valve stem. As a result, the uncaptured valve assembly is much less expensive than the captured valve assembly, but requires additional labor in its final assembly, as well as additional parts handling problems. Also, the uncaptured valve assembly requires an external biasing member to move the valve stem from a closed position to an open position and also to bias the valve stem in the closed position when combustible fluid flow is not desired.

An additional problem found uncaptured valve assemblies is leakage of the combustible fluid between the valve stem and the valve housing, which results in loss of fluid and can produce secondary ignition when the valve stem is in the open position. Secondary ignition is extremely undesirable since it can cause deterioration of the external member controlling the valve stem.

It is a principal object of this invention to provide a captured or self-contained valve assembly that is easy and inexpensive to manufacture and competitive with the cost of uncaptured valve assemblies.

Another object of this invention is to provide a captured or self-contained valve assembly of the above character which eliminates secondary ignition.

Another object of this invention is to provide a captured or self-contained valve assembly of the above character employing a die-cast or molded valve stem.

Other and more specific objects will in part be obvious and will in part appear hereinafter.

SUMMARY OF THE INVENTION

In the valve assembly of this invention, a die-cast or molded valve stem, similar to the type of valve stem employed in non-captured valve assemblies, is used in combination with a valve housing. However, a captured valve assembly is created by externally mounting a resilient flexible member about the valve stem and interconnecting the flexible member with the valve housing in tension so as to biasingly engage the valve stem with the valve housing. In this way, a completely captured or self-contained valve assembly is created having all of the advantages of a captured valve assembly while having the cost and component production advantages of an uncaptured valve assembly.

In the preferred embodiment, the flexible biasing member comprises a rubber material, which peripherally surrounds and engages the valve stem and the valve housing, and is mounted under sufficient tension to biasingly engage the valve stem in the closed position against the valve housing. As a result, the valve assembly of this invention is a completely closed or self-contained valve assembly ready for installation in a desired unit. Furthermore, this preferred embodiment which incorporates the peripherally surrounding rubber material prevents any escape of the combustible fluid between the walls of the valve stem and the valve houing, thereby eliminating leakage and secondary ignition.

The invention accordingly comprises an article of manufacture, possessing the features, properties, and the relation of elements which will be exemplified in the article hereinafter described, and the scope of the invention will be indicated in the claims.

THE DRAWINGS

For a fuller understanding of the nature and objects of the invention, reference should be had to the following detailed description taken in connection with the accompanying drawings, in which.

DETAILED DESCRIPTION

Figure 1:
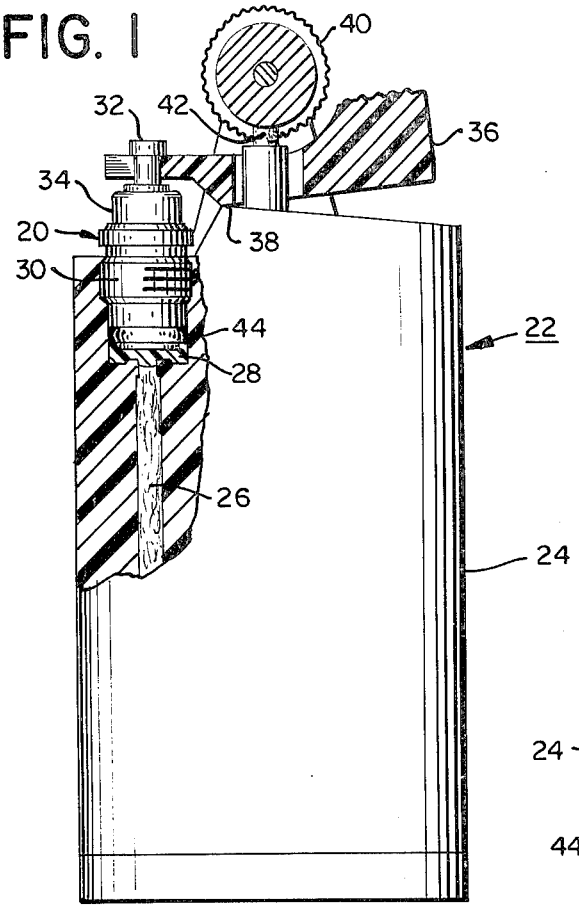
FIG. 1 is a side elevation view partially in cross section of a typical gas lighter employing the valve assembly of this invention.

In FIG. 1, valve assembly 20 is shown mounted in a typical gas lighter 22. The description and operation of valve assembly 20 will be made in reference to gas lighter 22 for exemplary purposes only. As will be obvious to one skilled in the art, valve assembly 20 of this invention can be used in other suitable operations employing combustible fluid with the use of the valve assembly of this invention in gas lighter 22 being merely exemplary of that use.

Figure 2:
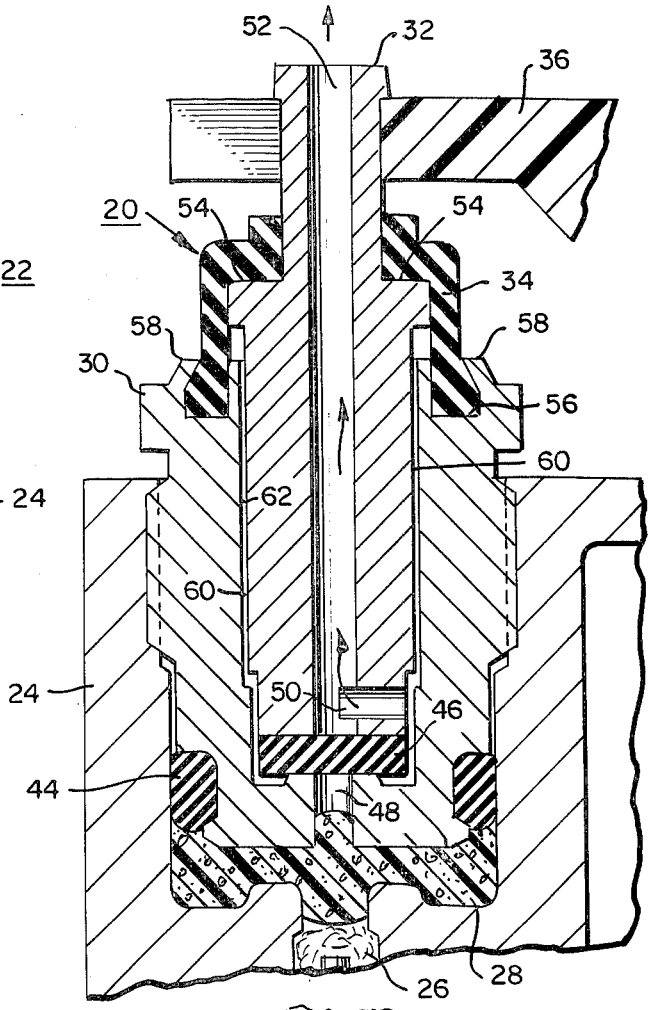
FIG. 2 is a cross-sectional side elevation view of one embodiment of the valve assembly of this invention, taken along line 2—2 of FIG. 1.

As shown in FIGS. 1 and 2, gas lighter 22 comprises a case 24 in which combustible fluid is contained. Presently, liquified butane is employed in many of the gas lighters. The combustible fluid is brought to a metering gasket 28 by means of wick 26. Both wick 26 and metering gasket 28 are particularly useful with butane fuel.

Valve assembly 20 is threadedly engaged with housing 24 of lighter 22, and comprises a housing 30 and a valve stem 32. As is more fully described below, valve stem 32 is biasingly engaged in housing 30 in a closed position by means of resiliently flexible biasing member 34. This is achieved by securing flexible member 34 to valve stem 32 and housing 30 in tension.

Since valve stem 32 is held in the closed position by flexible member 34, lever 36 is employed to move valve stem 32 vertically upward into the open position. Lever 36 incorporates a pivot point 38 and when lever 36 is moved downwardly, lever 36 pivots about pivot point 38, causing valve stem 32 to move upwardly into the open position, placing flexible member 34 under additional tension. When spark wheel 40 is rotated causing a spark to be produced by the friction between spark wheel 40 and flint 42, the gas escaping through valve stem 32 is ignited. Then, when the flame is to be extinguished, the downward force on lever 36 is removed and the resilient forces of flexible member 34 causes valve stem 32 back to the closed position.

By referring to FIG. 2, the contruction and operation of one embodiment of valve assembly 20 of this invention can best be understood. Housing 30 of valve assembly 20 is threadedly engaged with case 24 of lighter 22, and is sealed therein by means of O-ring seal 44. In the normal position, flexible member 34 is under sufficient tension to biasingly engage valve stem 32 with valve housing 30, maintaining valve stem 32 in the closed position by exerting sufficient force on valve stem 32 to maintain it in contact with gasket 46. As a result, the combustible fluid which passes through wick 26 and metering pad 28 into the portal 48 of housing 30 cannot enter into valve stem 32 when valve stem 32 is in the closed position. When lever 36 is moved, as discussed above, causing valve stem 32 to move upwardly, the combustible fluid enters portal 50 of valve stem 32 and passes through the center hole 52 of valve stem 32.

In the embodiment shown in FIG. 2, flexible member 34 is made of a rubber material and at one end peripherally surrounds valve stem 32, captured by ledge 54 of valve stem 32. The other end of flexible member 34 is secured within annular groove 56 of valve housing 30, retained therein by captured, fold-over detent 58. The dimensions between ledge 54 of valve stem 32 and groove 56 of housing 30 are made to assure that the proper amount of biasing pressure is exerted by flexible material 34 in order to maintain valve stem 32 sealed against gasket 56 in the normally closed position. However, flexible member 34 comprises sufficient elasticity which allows member 34 to stretch when arm 36 is moved and allow valve 32 to move upwardly, providing the desired combustible fluid flow. Furthermore, the resiliency of flexible member 34 assures that when the force is removed from lever 36 valve stem 32 is immediately returned to the normally closed position, securely blocking any further combustible fluid flow.

In this way, a completely captured or self-contained valve assembly is achieved with a minimum of parts without requiring a valve stem incorporating a plurality of various offset lands and grooves, as is required in prior art self-contained valve assemblies. In the captured or self-contained valve assembly of this invention, valve stem 32 can be manufactured by die-casting or molding or other similar processes used for manufacturing valve stems of the non-captured valve assembly types. As a result, the valve stem employed in the captured valve assembly of this invention is extremely less expensive than the valve stem employed in prior art captured valve assemblies.

An additional problem found with prior art non-captured valve assemblies is leakage of the combustible fluid and secondary ignition of this leaking fluid. Generally, when valve stem 32 has been raised in order to allow flow of the combustible fluid, through the valve stem, leakage may occur between outer wall 60 of valve stem 32 and inner wall 62 of valve housing 30. The only deterrent to this type of gas leakage is the tolerances which are employed for these interfitting parts. However, even though close tolerances are generally maintained, leakage does occur and can be ignited by the spark, causing undesirable deterioration of the surrounding parts.

By employing the captured valve assembly 20 of this invention, all of the cost advantages of a non-captured valve assembly are achieved, while also having all of the positive advantages of a captured valve assembly. One of these advantages is the complete elimination of all leakage and secondary ignition when employing the preferred embodiment of valve assembly 20. Gas leakage is completely prevented by the preferred embodiment of valve assembly 20, since biasing member 34 completely surrounds valve stem 32 and housing 30, providing a positive seal against escape of any gas between wall 60 of valve stem 32 and wall 62 of valve housing 30.

Figure 3:
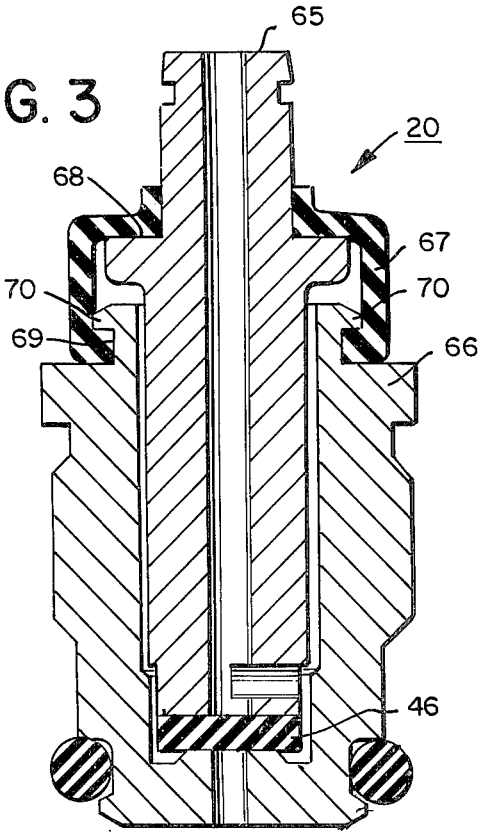
FIGS. 3 through 6 are cross-sectional side elevation views of alternative embodiments of the valve assembly of this invention.
Figure 4:
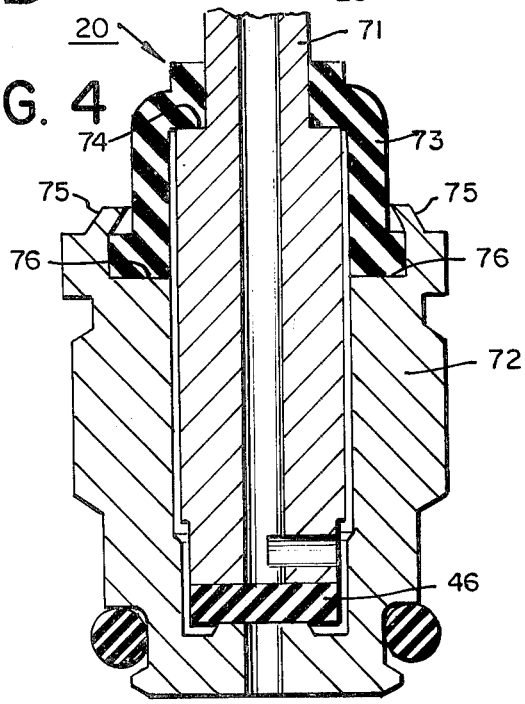

In FIGS. 3 and 4, additional embodiments of the valve assembly 20 of this invention are shown. These additional embodiments are shown merely for illustrative purposes in order to represent the various configurations that can be employed for a peripherally surrounding flexible member which biases the valve stem in the closed position with the valve housing, while also allowing sufficient resiliency to allow raising of the valve stem into an open position, while also resiliently returning said valve stem into the closed position when the raising force is eliminated.

In the embodiment shown in FIG. 3, valve stem 65 cooperates with valve housing 66 and is interconnected therewith and biasingly engaged in the closed position by flexible member 67. Although valve stem 65 has a slightly different configuration than valve stem 32 of FIG. 2, valve stem 65 is still manufacturable by die-casting or molding, and therefor can be manufactured in the less expensive manner similar to non-captured valve assemblies. Furthermore, flexible member 67 peripherally surrounds valve stem 65 maintained in its position by land 68, while being captured by peripherally surrounding groove 69 and tab 70 of valve housing 66. In this way, another embodiment for a captured valve assembly of this invention having all of the attributes of more expensive prior art captured valve assemblies is provided.

In FIG. 4, a third embodiment of the captured valve assembly of this invention is shown with valve stem 71 mounted within valve housing 72 and biasingly engaged therewith in the closed position by flexible biasing member 73. As with the other embodiment shown and discussed above, valve assembly 71 has an alternative configuration to the other embodiments. However, as with these other embodiments, valve stem 71 is capable of manufacture in the less expensive die-cast or molding processes. Flexible biasing member 73 peripherally surrounds and engages valve stem 71 retained thereon by ledge 74 near one end and at its other end is captured by tabs 75 and groove 76 of housing 72. In this way, as with the prior embodiments, flexible member 73 is mounted in tension and maintains valve stem 72 biased in the closed position against gasket 46, while also being resilient and flexible enough to allow valve stem 71 to be raised to an open position, increasing the tension thereon, and then resiliently biasingly return and hold valve stem 71 in the closed position against gasket 46.

In all of the embodiments discussed above, a flexible peripherally surrounding biasing member, preferably comprising a rubber composition, is disclosed. This biasing flexible member is preferred in order to provide a positive seal against leakage and secondary ignition. However, if the tolerances of the valve stem and the valve housing are maintained in order to provide a close sliding engagement between the two components of the valve assembly, the rubberlike material need not be employed and a coil spring could be employed to provide the desired biasing forces. Two alternative embodiments employing coil springs are shown in FIGS. 5 and 6.

Figure 5:
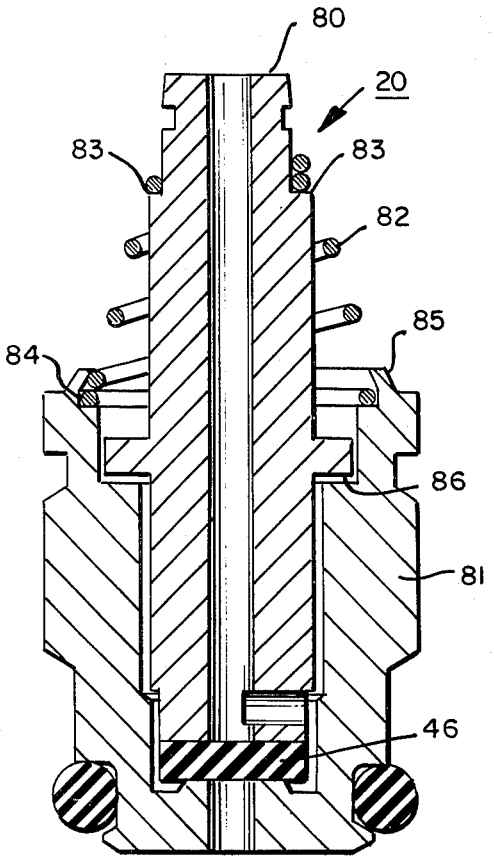

In FIG. 5, one embodiment of valve assembly 20 of this invention is shown with valve stem 80 mounted in place within valve housing 81, biasingly maintained in the closed position against gasket 46 by coil spring 82. In this embodiment, coil spring 82 comprises a conical-shaped coil spring mounted at one end about valve stem 80 retained in this position by land portion 83 and secured at its other end to valve housing 81 within groove 84 maintained and captured in this position by fold-over tab 85. As discussed above, spring 82 is mounted to valve assembly 20 in tension in order to assure that valve stem 80 is normally maintained against gasket 46, assuring valve assembly 20 is in the closed position. The desired pressure necessary to maintain valve stem 80 in this closed position depends upon the specific requirements of the use for valve assembly 20, and can range anywhere from 0.25 lbs. per sq. in. to several lbs. per sq. in. As will be obvious to one skilled in the art, specific spring tensions or rubber materials would be provided on the valve assembly in order to assure the desire biasing forces, while also being resilient enough to allow stretching to the open position and biasing resilient return to the closed position.

Valve stem 80 also incorporates a radially extending shelf portion 86 in order to provide an additional deterrent to gas leakage and secondary ignition. Although coil spring 80 does not provide the positive seal against gas leakage between the outer wall of valve stem 80 and the inner wall of valve housing 81, radially extending shelf 86 does provide an additional deflection baffle around which the gas must pass before it could emerge from housing 81 and be ignited. It has been found that the inclusion of such a deflection baffle provides sufficient deterrent to gas leakage in most normal situations, thereby substantially eliminating secondary ignition difficulties. Furthermore, valve stem 80 can be manufactured by molding or die-cast processes, and is therefore inexpensive to manufacture. Therefore, a valve assembly having the cost features of an uncaptured valve assembly is provided with all of the desirable features of a captured valve assembly.

Figure 6:
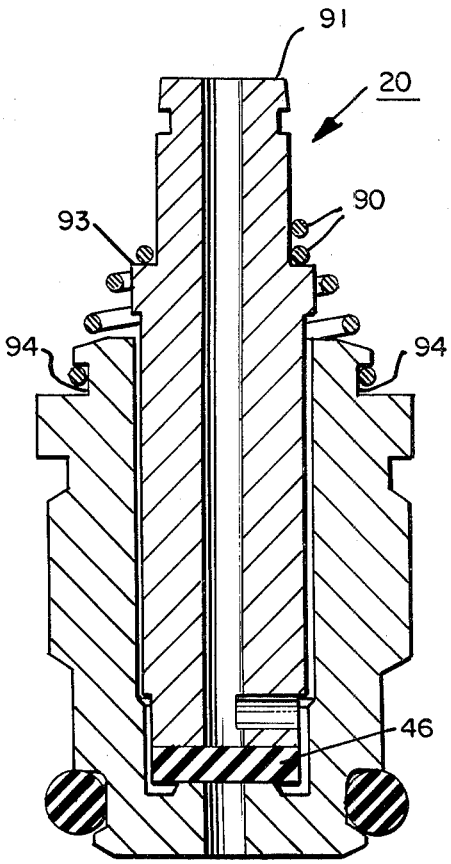

In FIG. 6, an alternative mounting arrangement for securing coil spring 90 to valve stem 91 and housing 92 is shown. In this embodiment, one end of coil spring 90 peripherally surrounds valve stem 91 retained in this position by shelf 93. The other end of coil spring 90 is captured within peripherally surrounding recess 94 of valve housing 92. This configuration has assembly advantages since coil spring 90, which is preferably of an overall conical shape, can be quickly and easily placed over valve stem 90, retaining one end about shelf 93 and snapping the other end within recess 94 of housing 92. In this way, a captured valve assembly is quickly and easily provided which maintains valve stem 90 in the closed position firmly engaged against gasket 46, while still being capable of resiliently stretching to an open position and then biasingly returning to the closed secured position. Also, since valve stem 91 is manufacturable by the less expensive processes discussed above, this embodiment of the valve assembly of this invention provides another efficient captured valve assembly which is quickly and rapidly assemblable, using inexpensive parts and providing all of the features of the more expensive prior art captured valve assemblies.

As would be obvious to one skilled in the art, many variations of construction for the valve assembly of this invention are possible. Several various embodiments have been disclosed for exemplary purposes in order to show some of these possible variations. However, it is believed that the essential feature of providing an inexpensive captured valve assembly is clearly obtainable, employing the teaching of this invention, by providing a valve stem and a valve housing with an externally mounted flexible member which biasingly engages the valve stem in the closed position with the valve housing, while still being capable of flexing to an open valve position and resiliently biasing said valve assembly into the closed position when the opening force has been removed.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sence.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A leak-free valve assembly comprising:

a. a housing incorporating a. a combustible fluid portal positioned for receiving and passing said combustible fluid therethrough, b. an internal chamber extending substantially the entire length of said housing and communicating with said fluid portal;

b. a hollow valve stem a major portion of which is slidably mounted within said internal chamber of said housing, the remainder of which extends therefrom above said housing, said valve stem being movable from a first closed position to a second open, fluid flow position;

c. a flexible, leak-preventing member peripherally surrounding and encapsulating portions of said housing and said valve stem, with a. one end thereof sealingly engaged about a shoulder of the valve stem above the housing with the valve stem extending through and above said member, and b. the remainder thereof extending therefrom peripherally surrounding the valve stem, with the other end pressed between opposed upper portions of said housing and biasing the valve stem into a closed position, whereby leakage between the outer peripheral surface of the valve stem and the inner chamber of the housing to the atmosphere is completely eliminated by said leak-preventing member completely sealing any leakage zone.

2. The valve assembly defined in claim 1, wherein said flexible, leak-preventing member comprises a rubber material.

3. The valve assembly defined in claim 1, wherein said flexible, leak-preventing member is mounted between said valve stem and said housing under tension.

4. A leak-free valve assembly mounted within a gas lighter comprising;

A. a housing a. threadedly engaged in a substantially sealed configuration with said gas lighter, b. incorporating a combustible fluid portal positioned for passage of said combustible fluid therethrough, and c. an inner chamber extending substantially the entire length of said housing and communicating with said fluid portal;

B. sealing means mounted within said housing and positioned at the exit end of said fluid flow portal for reducing fluid leakage between the walls of a valve stem and said inner chamber;

C. a valve stem a. a major portion of which is slidably mounted within said chamber of said housing with the end associated therewith in abutting contact with said sealing means, and b. the remainder of said valve stem extending from said housing with its associated end responsive to lever means for raising said valve stem from a first closed position to a second open position;

D. a flexible, self-biasing, leak-preventing, rubber-like member peripherally surrounding and encapsulating portions of said housing and said valve stem, with a. one end thereof securely engaged about a shoulder of said valve stem above said housing, and b. the remainder thereof extending therefrom under tension periphperally surrounding the valve stem, with the other end pressed between opposed upper portions of said housing, whereby said valve stem is normally biasingly engaged with said housing in said first closed position and leakage through said sealing means and between the walls of the valve stem and the inner chamber of the housing to the atmosphere is completely prevented by said self-biasing, leak-preventing rubber-like member, and E. lever means engaged about the exposed end of said valve stem and positioned for counteracting said biasing engaging forces of said flexible, self-biasing, leak-preventing, rubber-like member by raising said valve stem from the closed position to an open position in response to an external force, whereby said valve assembly is normally in the closed position maintained therein by said flexible self-biasing, rubber-like member which provides for elastic movement of said valve stem to the open position in response to the external force on the lever means for the biasingly resilient return of the valve stem to said closed position upon removal of said force from said lever means, and secondary ignition completely eliminated by sealing the entire vented area between the walls of the valve stem and the inner chamber of the housing by said leak-preventing, rubber-like member.

* * * * *

UNITED STATES PATENT AND TRADEMARK OFFICE

CERTIFICATE OF CORRECTION

PATENT NO. : 3,961,876

DATED : June 8, 1976

INVENTOR(S) : Stephen P. Chernock

It is certified that error appears in the above-identified patent and that said Letters Patent are hereby corrected as shown below:

Column 1, Line 33, "accomodate" should be --accommodate--

Column 2, Line 33, "houing" should be --housing--

Column 6, Line 47, "sence" should be --sense--

Column 6, Line 56 through Column 7, Line 12 is changed to read as corrected below:

A) a housing incorporating
   a) a combustible fluid portal positioned for receiving and passing said combustible fluid therethrough,
   b) an internal chamber extending substantially the entire length of said housing and communicating with said fluid portal;

B) a hollow valve stem a major portion of which is slidably mounted within said internal chamber of said housing, the remainder of which extends therefrom above said housing, said valve stem being movable from a first closed position to a second open, fluid flow position;

C) a flexible, leak-preventing member peripherally surrounding and encapsulating portions of said housing and said valve stem, with
   a) one end thereof sealingly engaged about a shoulder of the valve stem above the housing with the valve stem extending through and above said member, and
   b) the remainder thereof extending therefrom peripherally surrounding the valve stem, with the other end pressed between opposed upper portions of said housing and biasing the valve stem into a closed position, Signed and Sealed this Twelfth Day of October 1976

[SEAL]

*Attest:*

RUTH C. MASON
*Attesting Officer*

C. MARSHALL DANN
*Commissioner of Patents and Trademarks*